US010683463B2

(12) United States Patent
Kim

(10) Patent No.: US 10,683,463 B2
(45) Date of Patent: Jun. 16, 2020

(54) SOLID LUBRICANT COMPOSITIONS AND BEARINGS INCORPORATING THE SAME

(71) Applicant: GGB, Inc., Thorofare, NJ (US)

(72) Inventor: Michael Kim, Marlton, NJ (US)

(73) Assignee: GGB, Inc., Thorofare, NJ (US)

( * ) Notice: Subject to any disclaimer, the term of this patent is extended or adjusted under 35 U.S.C. 154(b) by 0 days.

(21) Appl. No.: 16/006,617

(22) Filed: Jun. 12, 2018

(65) Prior Publication Data

US 2018/0355271 A1 Dec. 13, 2018

Related U.S. Application Data

(60) Provisional application No. 62/518,784, filed on Jun. 13, 2017.

(51) Int. Cl.

| | |
|---|---|
| ***C10M 111/04*** | (2006.01) |
| ***C10M 101/02*** | (2006.01) |
| ***C10M 107/04*** | (2006.01) |
| ***C10M 107/38*** | (2006.01) |

(52) U.S. Cl.

CPC ..... *C10M 111/04* (2013.01); *C10M 101/025* (2013.01); *C10M 107/04* (2013.01); *C10M 107/38* (2013.01); *C10M 2205/143* (2013.01); *C10M 2205/163* (2013.01); *C10M 2213/062* (2013.01); *C10M 2213/0623* (2013.01); *C10N 2220/082* (2013.01); *C10N 2230/06* (2013.01); *C10N 2240/02* (2013.01); *C10N 2250/08* (2013.01); *C10N 2250/10* (2013.01)

(58) Field of Classification Search

CPC ..... C10N 2250/08; C10N 2240/02; C10M 2205/143; C10M 2213/062; C10M 2205/163

See application file for complete search history.

(56) References Cited

U.S. PATENT DOCUMENTS

| | | | | |
|---|---|---|---|---|
| 5,686,176 | A * | 11/1997 | Adam | C08K 3/26 428/327 |
| 6,106,936 | A | 8/2000 | Adam | |
| 6,852,677 | B2 | 2/2005 | Kurz et al. | |
| 2015/0133350 | A1 | 5/2015 | Yamamoto et al. | |
| 2016/0145886 | A1 | 5/2016 | Kochiyama et al. | |
| 2017/0081522 | A1 | 3/2017 | Adam et al. | |

OTHER PUBLICATIONS

PCT Application No. PCT/US2018/037130, International Search Report and Written Opinion dated Feb. 21, 2019, 13 pages.

* cited by examiner

*Primary Examiner* — Vishal V Vasisth

(74) *Attorney, Agent, or Firm* — Perkins Coie LLP

(57) ABSTRACT

A solid lubricant composition comprising a wax carrier and agglomerates of PTFE micropowder dispersed throughout the wax carrier is disclosed. In some embodiments, the solid lubricant composition is applied to an interior surface of a cylindrical plain bearing. In other embodiments, a polymer sliding layer having a plurality of indentations formed therein is applied to the interior surface of a metal shell, and the solid lubricant composition described herein is disposed in the indentations, to thereby form a cylindrical plain bearing having a sliding layer of both the polymer material and the solid lubricant composition.

16 Claims, 5 Drawing Sheets

SOLID LUBRICANT COMPOSITIONS AND BEARINGS INCORPORATING THE SAME

CROSS REFERENCE TO RELATED APPLICATIONS

The present application claims priority to U.S. Provisional Patent Application No. 62/518,784, filed Jun. 13, 2017, the entirety of which is hereby incorporated by reference.

TECHNICAL FIELD

The present application relates to a solid lubricant compositions, and more specifically, solid lubricant compositions including a wax carrier and agglomerates of PTFE micropowder dispersed throughout the wax carrier.

BACKGROUND

Metal-polymer bearings have previously been used in many applications, with grease sometimes added to provide or improve lubrication. These metal-polymer bearings have traditionally shown better wear resistance as compared to metallic bearings when grease is used for lubrication. FIG. 1 shows the improved wear resistance of a metal-polymer bearing (DX=Acetal-lined) as compared to a bronze bearing (660 grade) in a greased application (with repeated grease re-application). As shown in FIGS. 2 and 3, the use of higher performance polymers in metal-polymer bearings (DX10=PA4.6-lined) provide even better wear resistance in both clean grease and abrasive debris-containing grease.

However, a key disadvantage associated with the use of grease in bearing applications is the requirement to re-lubricate. Grease will generally migrate from the load zone, requiring constant maintenance and re-application. Grease also attracts and retains debris, creating the requirement for frequent re-greasing to purge abrasive particles that can harm a bearing, and especially polymer-lined bearings. Insufficient maintenance of a greased bearing can lead to early failure either from lack of lubricant or presence of abrasive debris.

Additionally, grease may migrate from the loaded area of the bearing as a result of load and relative motion. Environmental issues with grease also work against its continued broad-based usage.

The combination of paraffin wax with solid lubricants such as PTFE or other fluoropolymers has previously been identified as having useful lubricating characteristics. However, such combinations have generally been targeted at low temperature applications such as snow skis or other snow-sliding elements. Additionally, the use of such previously known grease-free lubrication methods have not been useful for grease-replacement in the industrial bearing space because of the temperature limitations of the lubricant and the requirement for higher-temperature operation typical in normal industrial bearing lubrication.

Accordingly, a need exists for a grease-free bearing showing wear resistance comparable to, or better than, that exhibited when grease is used as a lubricant, and which is effective at high operating temperatures.

SUMMARY

This Summary is provided to introduce a selection of concepts in a simplified form that are further described below in the Detailed Description. This Summary, and the foregoing Background, is not intended to identify key aspects or essential steps of the claimed subject matter. Moreover, this Summary is not intended for use as an aid in determining the scope of the claimed subject matter.

In some embodiments, a solid lubricant composition is disclosed, the solid lubricant composition comprising from 50 to 70 wt % paraffin wax and from 30 to 50 wt % PTFE micropowder. The paraffin wax used in the composition may be a paraffin wax having a melting point of greater than 70° C. The PTFE micropowder may be present in the composition in the form of agglomerates having a size of about 200 μm.

In some embodiments, the solid lubricant composition is used as a coating layer on an interior surface of a plain bearing. The plain bearing may be a cylindrical plain bearing made from a metal material with the solid lubricant composition coated on some or all of the interior surface of the cylindrical bearing.

In some embodiments, the solid lubricant composition described herein is provided in indentations formed in a polymer layer formed on an interior surface of a plain bearing. The indentations act as reservoirs into which the solid lubricant composition is disposed. The solid lubricant composition disposed in the indentations/reservoirs is gradually released during use of the bearing to thereby provide lubrication, reduce friction and wear, and extend the life of the bearing. The solid nature of the solid lubricant composition increases the stability of lubricant performance, as opposed to typical greases that will migrate from the bearing load zone and cause deleterious friction increases. The dry nature of the solid lubricant composition also reduces dust pick up onto the counterface in comparison with other oil lubricated systems.

BRIEF DESCRIPTION OF THE DRAWINGS

Non-limiting and non-exhaustive embodiments of the disclosed solid lubricant composition, including the preferred embodiment, are described with reference to the following figures, wherein like reference numerals refer to like parts throughout the various views, uncles otherwise specified.

DETAILED DESCRIPTION

Figure 1:
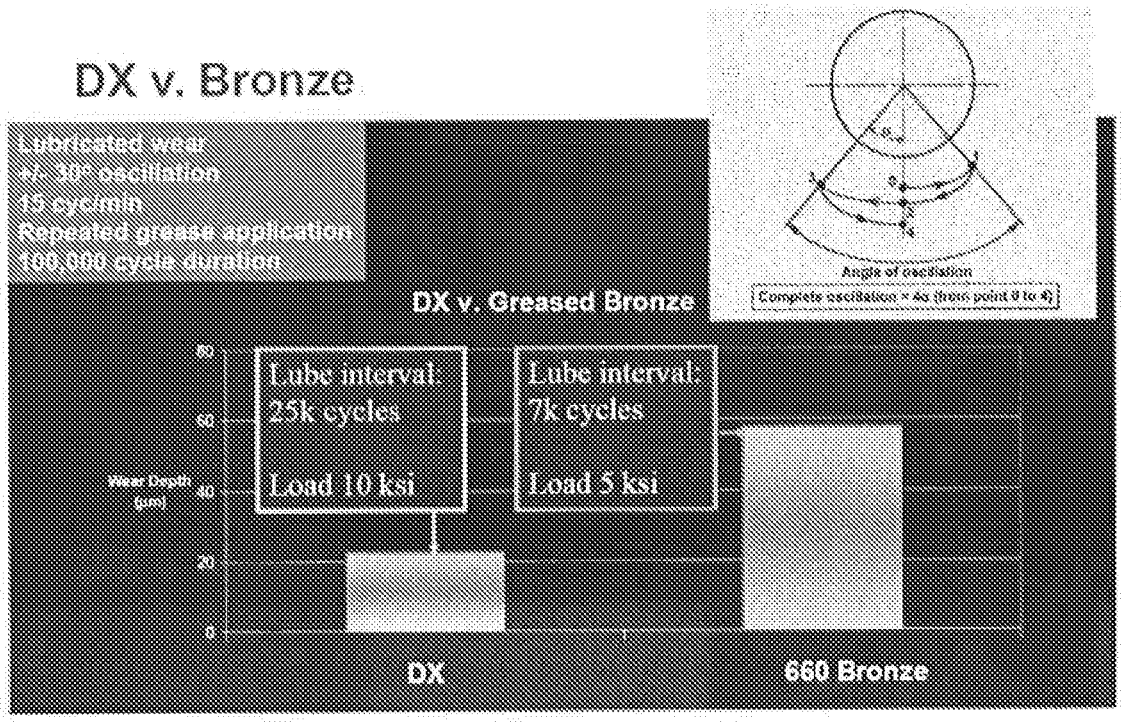
FIG. 1 is a graph illustrating the wear resistance of a previously known metal-polymer bearing (DX=Acetal-lined) as compared to a previously known bronze bearing (660 grade) in a greased application.
Figure 2:
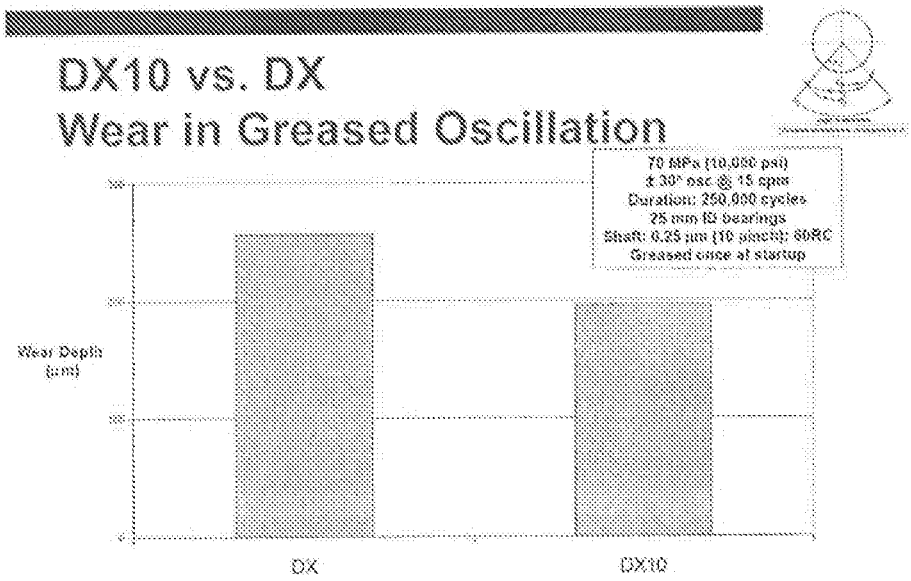
FIGS. 2 and 3 are graphs illustrating the wear resistance of previously known higher performance polymers in metal-polymer bearings (DX10=PA4.6-lined) in clean grease and abrasive debris-containing grease, respectively.
Figure 3:
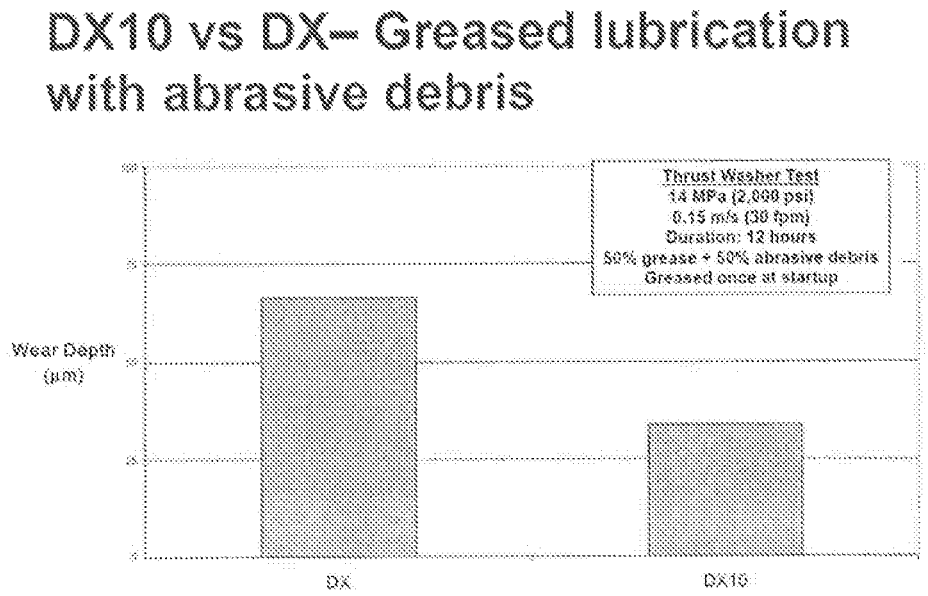

Embodiments are described herein more fully below with reference to the accompanying Figures, which form a part hereof and show, by way of illustration, specific exemplary embodiments. These embodiments are disclosed in sufficient detail to enable those skilled in the art to practice the invention. However, the embodiments may be implemented in many different forms and should not be construed as being limited to the embodiments set forth herein. The following Detailed Description is, therefore, not to be taken in a limiting sense.

Disclosed herein is a solid lubricant composition suitable for use with a bearing. The solid lubricant composition may be used as, for example, a coating layer on an interior surface of a plain bearing, or in conjunction with a polymer lining on an interior surface of a plain bearing. In some embodiments, the solid lubricant composition comprises a wax component and a polytetrafluoroethylene (PTFE) component. In some embodiments, the wax component is a paraffin wax, though other wax types may be used. In some embodiments, the PTFE component is PTFE micropowder. The solid lubricant composition may include from 50 to 70 wt % of the wax component and from 30 to 50 wt % of the PTFE component.

In some embodiments, the solid lubricant composition includes from 50 to 70 wt % of a wax component. The wax component serves as a carrier. In some embodiments, the wax component of the solid lubricant composition is a paraffin wax. Single or blended grades of paraffin waxes may be used. Other types of waxes that can be used (either in combination with a paraffin wax or in place of a paraffin wax) are microcrystalline waxes and polyethylene waxes.

In some embodiments, the wax component used in the solid lubricant composition has a melting point of 70° C. or higher. For example, suitable waxes for use in the solid lubricant composition described herein include IGI 1260 (paraffin wax having melting point of greater than 70° C.), Acculin 725 (polyethylene wax having melting point of greater than 100° C.) and Acculin 2000 (polyethylene wax having melting point of greater than 125° C.). Each of the Acculin and IGI waxes are supplied by The International Group, Inc. of Toronto, Ontario, Canada.

In some embodiments, the solid lubricant composition includes from 30 to 50 wt % of a PTFE component. In some embodiments, a preferred amount of PTFE component is about 40 wt %. The PTFE component can be in the form of PTFE micropowder. In some embodiments, the PTFE micropowder has an individual particle size of between 11 and 17 μm.

While the individual particle size of the PTFE micropowder may be in the range of 11 to 17 μm, the PTFE micropowder may be present in the solid lubricant composition in the form of larger agglomerates of the micropowder. PTFE agglomerations are believed to allow for easy spreading of the lubricant composition on a substrate and provide low and constant friction. Utilizing PTFE agglomerates is believed to be especially beneficial during break-in. In some embodiments, the PTFE is present in the solid lubricant composition in the form of agglomerates having a size of approximately 200 μm. The method of preparing the solid lubricant composition may be carried out to encourage formation of these agglomerates. PTFE micropowders suitable for use in the preparation of the disclosed solid lubricant composition include DuPont Zonyl MP1000, DuPont Zonyl MP 1300 and DuPont Zonyl MP 1400. In some embodiments, the agglomerates of PTFE are homogenously dispersed throughout the carrier wax components such that the PTFE is evenly dispersed throughout the solid lubricant composition.

In some embodiments, the PTFE component is the only filler used in the solid lubricant composition. Tests were carried out using additional fillers in the solid lubricant composition (e.g., graphite particles), but the solid lubricant composition including only PTFE performed better than when additional fillers were added.

Any method of preparing the solid lubricant composition can be used. In some embodiments, a processing method that keeps the agglomerates in place instead of breaking up the agglomerates to thereby entrain PTFE micropowder in the carrier is used.

Figure 4:
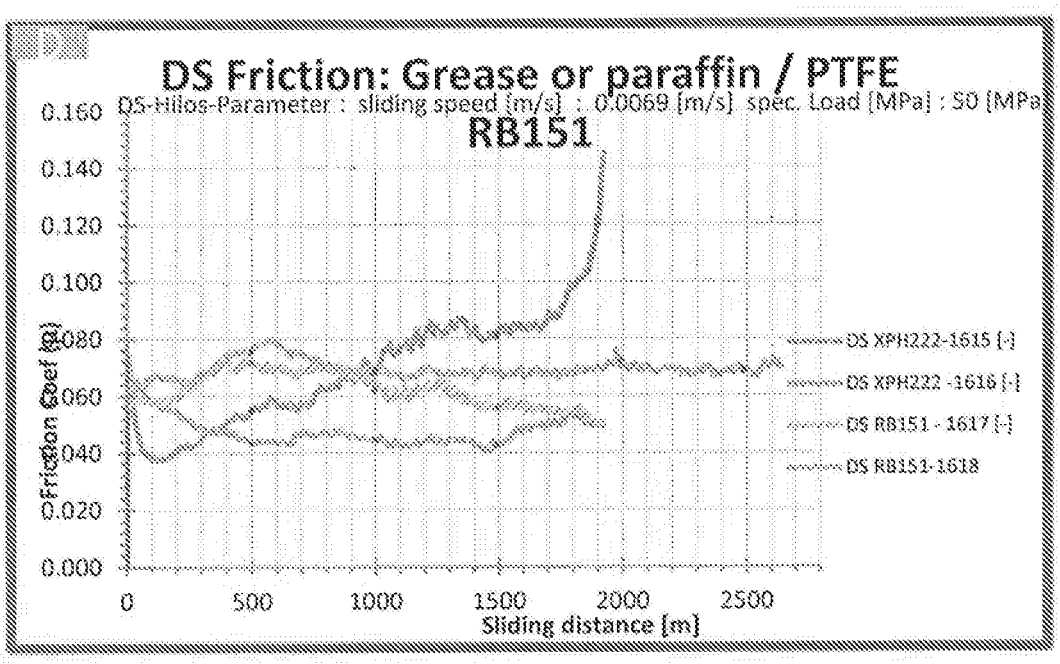
FIGS. 4-6 show comparative data between applications of grease and applications of the solid lubricant composition described herein, including improved coefficient of friction and improved wear rate for the solid lubricant composition.
Figure 5:
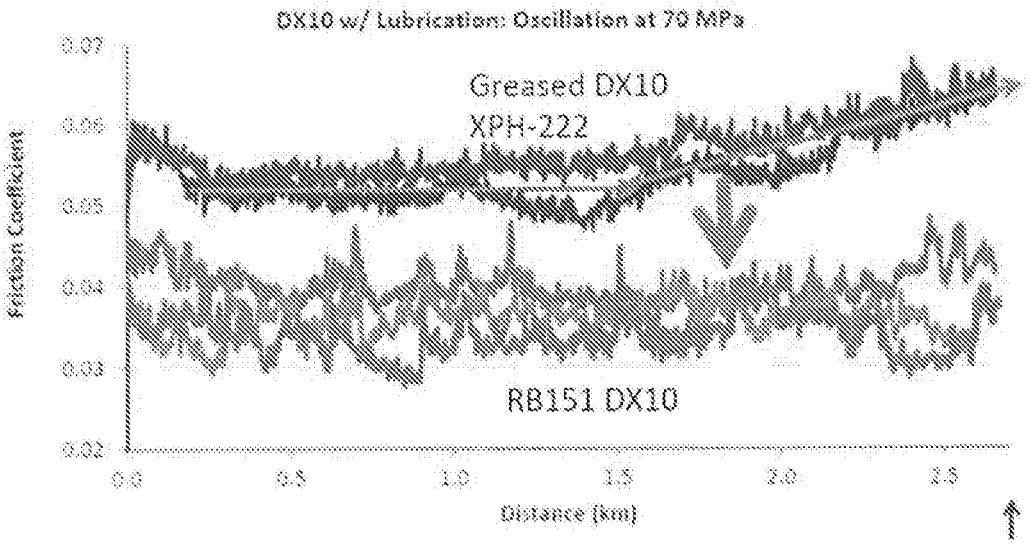
Figure 6:
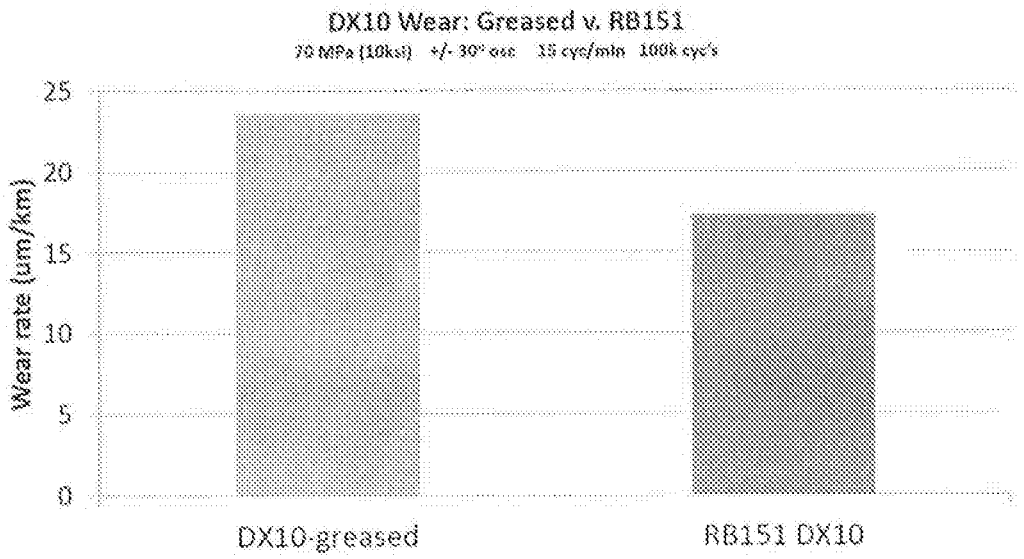

FIGS. 4-6 are graphs showing further data obtained when comparing the performance of bearings using grease (referred to in the graphs as XPH222) versus bearings using the disclosed solid lubricant composition (referred to in the graphs as RB151). FIG. 4 shows how the coefficient of friction stays relatively constant over the sliding distance when the solid lubricant composition is used, whereas some uses of grease show a dramatic increase in coefficient of friction over sliding distance. FIG. 5 shows how the solid lubricant maintains a relatively constant coefficient of friction over distance when 70 MPa of oscillation is applied. The coefficient of friction for the solid lubricant is lower than the coefficient of friction observed when grease is used. The coefficient of friction also goes up after 1.5 km of distance (approximately 50k cycles of oscillation) when grease is used, whereas the coefficient of friction remains relatively constant over distance when the solid lubricant composition is used. Finally, FIG. 6 show the improved wear rate observed when comparing greased applications to the use of the solid lubricant composition disclosed herein.

Figure 7:
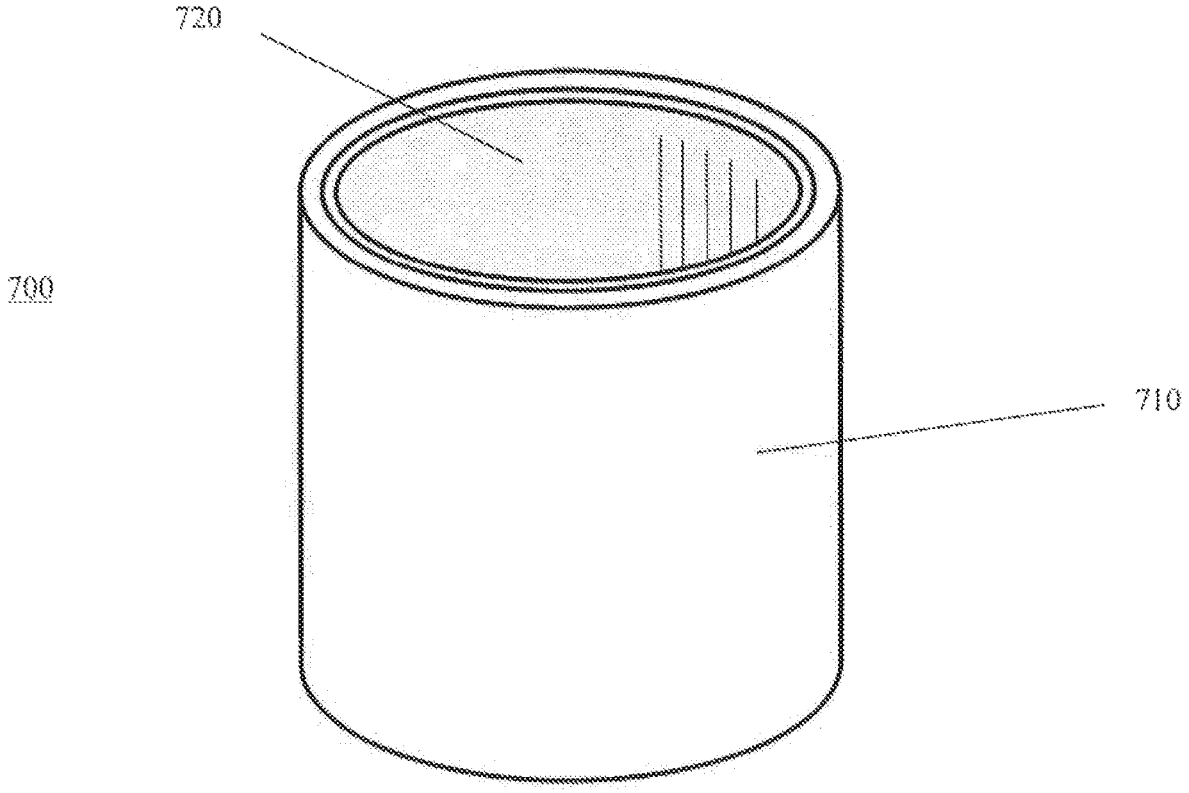
FIG. 7 is a perspective view of a bearing having an internal sliding layer of the solid lubricant composition described herein.

With reference to FIG. 7, a bearing 700 having a metal shell 710 and a lubricant layer 720 disposed on the internal surface of the metal shell 710 is illustrated. The metal shell may have a generally cylindrical shape, and may be made from any metal material suitable for use in a bearing. The internal surface is coated either partially or completely with a lubricant layer 720, with the lubricant layer being made from the solid lubricant composition described herein. The dimensions of the metal shell 710 are generally not limited and may be selected based on the specific application in which the bearing will be used. The thickness of the lubricant layer 720 is also generally not limited, and can be selected based on the specific application of the bearing.

The manner in which the lubricant layer 720 is applied to the metal shell 710 is not limited. In some embodiments, the lubricant layer 720 is applied to the internal surface of the metal shell 710 by a dip-type process where the part is submerged in liquid lubricant, removed for solidification, and the excess removed. The lubricant may also be injected into the bore of the bearing in a method similar to injection molding of a thermoplastic. The lubricant may also be "rolled" into the surface whereby the liquid lubricant is applied ahead of a turning rod, while the part is progressed relative to the rod. The lubricant may also be spread into the surface using a knife or "Doctor Blade" system. The lubricant may also be sprayed onto the surface, and the excess removed by a scraping or broaching process. The coating may also be injected into the bore in a process similar to injection molding that is used for processing of thermoplastic polymeric materials. The coating process is not limited to the described examples, but any suitable system may be used to obtain the desired result.

Figure 8:
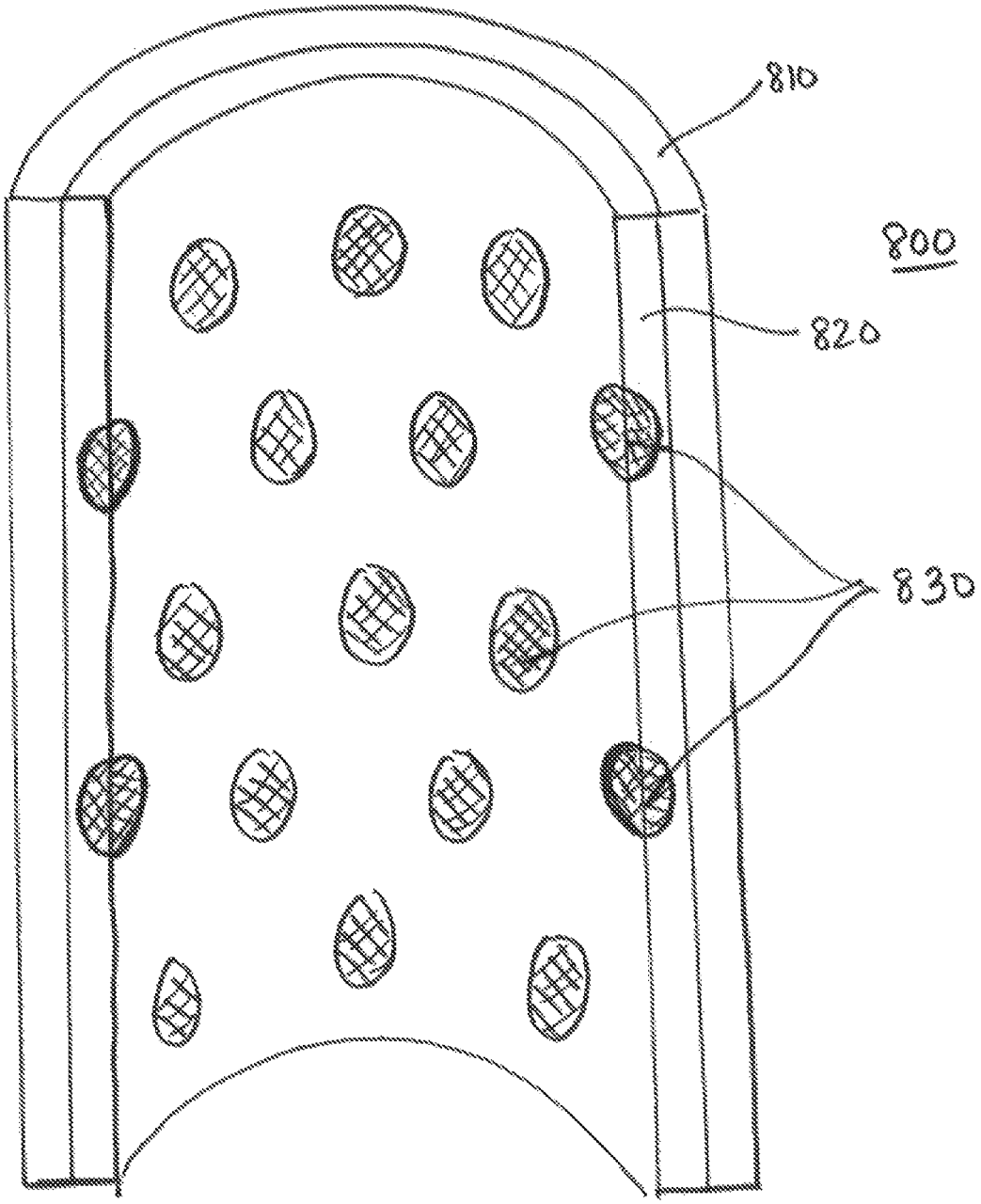
FIG. 8 is a cross-sectional perspective view of a bearing having reservoirs of solid lubricant composition as described herein provided on the internal surface of the bearing.

With reference to FIG. 8, a bearing 800 having a metal shell 810, a polymer sliding layer 820 disposed on an internal surface of the metal shell 810, and pockets of solid lubricant 830 disposed in reservoirs formed in the polymer layer is illustrated. The metal shell 830 may have a generally cylindrical shape, and may be made from any metal material suitable for use in a bearing. The internal surface of the metal shell 830 is coated with a polymer sliding layer 820.

The polymer sliding layer 820 may be any polymer suitable for use in forming a sliding layer on a bearing. Exemplary materials include, but are not limited to polyamide-based thermoplastic liners; PEEK-based thermoplastic liners, PBT-based thermoplastic liners, acetal-based thermoplastic or any polymer that may be melt extruded into the form of a film.

The dimensions of the metal shell 810 are generally not limited and may be selected based on the specific application in which the bearing will be used. The thickness of the polymer sliding layer 820 is also not limited, though in some embodiments, the thickness of the polymer sliding layer 820 is in the range of from 100 μm to 500 μm.

The manner in which the polymer sliding layer 820 is applied to the metal shell 810 is not limited. In some embodiments, the polymer sliding layer 820 is applied to the internal surface of the metal shell 810 by impregnation into a porous bronze structure. It also may be applied via insert injection molding into the bore of a metallic shell, or by direct adhesion of the polymer layer to the metal backing by an intrinsic affinity between the polymer and metal, or by an intermediate adhesive layer, or by a direct polymer coating process such as dipping, spraying, etc.

The polymer sliding layer 820 is also formed with a plurality of indents or depressions that generally form reservoirs in the polymer layer 820. Any number of reservoirs having any shape and provided in any pattern can be used. Each reservoir formed in the polymer layer 820 is filled with the solid lubricant composition 830 to thereby provide pockets of solid lubricant throughout the interior surface of the polymer sliding layer 820. The reservoirs are filled with the solid lubricant composition such that the solid lubricant 830 is flush with the surface of the polymer layer 820. The depth of the reservoirs may be equal to or less than the thickness of the polymer layer 820.

The solid lubricant composition 830 disposed in the reservoirs is gradually released during use of the bearing 800 to thereby provide lubrication, reduce friction and wear, and extend the life of the bearing 800. The solid nature of the solid lubricant composition 830 increases the stability of lubricant performance, as opposed to typical greases that will migrate from the bearing load zone and cause deleterious friction increases. The dry nature of the solid lubricant composition 830 also reduces dust pick up onto the counterface in comparison with other oil lubricated systems.

From the foregoing, it will be appreciated that specific embodiments of the invention have been described herein for purposes of illustration, but that various modifications may be made without deviating from the scope of the invention. Accordingly, the invention is not limited except as by the appended claims.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended.

Unless otherwise indicated, all numbers or expressions, such as those expressing dimensions, physical characteristics, etc., used in the specification (other than the claims) are understood as modified in all instances by the term "approximately". At the very least, and not as an attempt to limit the application of the doctrine of equivalents to the claims, each numerical parameter recited in the specification or claims which is modified by the term "approximately" should at least be construed in light of the number of recited significant digits and by applying rounding techniques. Moreover, all ranges disclosed herein are to be understood to encompass and provide support for claims that recite any and all sub-ranges or any and all individual values subsumed therein. For example, a stated range of 1 to 10 should be considered to include and provide support for claims that recite any and all sub-ranges or individual values that are between and/or inclusive of the minimum value of 1 and the maximum value of 10; that is, all sub-ranges beginning with a minimum value of 1 or more or ending with a maximum value of 10 or less (e.g., 5.5 to 10, 2.34 to 3.56, and so forth) or any values from 1 to 10 (e.g., 3, 5.8, 9.9994, and so forth).

I claim:

1. A solid lubricant composition, comprising:
50 to 70 wt % of polyethylene wax; and
30 to 50 wt % of a PTFE component dispersed in the polyethylene wax, wherein the PTFE component is the only material dispersed in the polyethylene wax.

2. The solid lubricant composition of claim 1, wherein the polyethylene wax has a melting point of 100° C. or greater.

3. The solid lubricant composition of claim 1, wherein the PTFE component is PTFE micropowder.

4. The solid lubricant composition of claim 3, wherein the size of the individual particles of the PTFE micropowder is from 11 μm to 17 μm.

5. The solid lubricant composition of claim 3, wherein the PTFE micropowder is present in the solid lubricant composition in the form of agglomerates of a plurality of individual particles of the PTFE micropowder.

6. The solid lubricant composition of claim 5, wherein the agglomerates have a size of about 200 μm.

7. A cylindrical plain bearing, comprising:
a cylindrical metal shell; and
a lubricant layer formed on an inner surface of the cylindrical metal shell, the lubricant layer comprising:
50 to 70 wt % of polyethylene wax; and
30 to 50 wt % of PTFE micropowder, wherein the PTFE micropowder is dispersed in the polyethylene wax and the PTFE micropowder is the only material dispersed in the polyethylene wax.

8. The cylindrical plain bearing of claim 7, wherein the polyethylene wax has a melting point of 100° C. or greater.

9. The cylindrical plain bearing of claim 7, wherein the PTFE micropowder is present in the lubricant layer in the form of agglomerates of a plurality of individual particles of the PTFE micropowder.

10. The cylindrical plain bearing of claim 9, wherein the agglomerates have a size of about 200 μm.

11. The cylindrical plain bearing of claim 7, wherein the entirety of the inner surface of the cylindrical metal shell is coated with the lubricant layer.

12. A cylindrical plain bearing, comprising:
a cylindrical metal shell;
a polymer sliding layer formed on an inner surface of the cylindrical metal shell, the polymer sliding layer having a plurality of indentations formed therein; and
a solid lubricant composition disposed in each of the indents formed in the polymer sliding layer, the solid lubricant composition comprising:
50 to 70 wt % of polyethylene wax; and
30 to 50 wt % of PTFE micropowder, wherein the PTFE micropowder is dispersed in the polyethylene wax and the PTFE micropowder is the only material dispersed in the polyethylene wax.

13. The cylindrical plain bearing of claim 12, wherein the material of the polymer sliding layer is selected from the group consisting of polyamide-based thermoplastic liners, PEEK-based thermoplastic liners, PBT-based thermoplastic liners, and acetal-based thermoplastic.

14. The cylindrical plain bearing of claim 12, wherein the polyethylene wax has a melting point of 100° C. or greater.

15. The cylindrical plain bearing of claim 12, wherein the PTFE micropowder is present in the lubricant layer in the form of agglomerates of a plurality of individual particles of the PTFE micropowder, and the agglomerates have a size of about 200 μm.

16. The cylindrical plain bearing of claim 12, wherein the entirety of the inner surface of the cylindrical metal shell is coated with the polymer sliding layer.

* * * * *